United States Patent [19]

Yamaguchi et al.

[11] 3,999,312

[45] Dec. 28, 1976

[54] WATER JET TYPE UNDERWATER GROUND EXCAVATOR

[75] Inventors: Mitsuo Yamaguchi; Kaisuke Shiroyama, both of Tokyo, Japan

[73] Assignee: Furukawa Electric Co., Ltd., Tokyo, Japan

[22] Filed: May 5, 1975

[21] Appl. No.: 574,593

[30] Foreign Application Priority Data

May 8, 1974 Japan .....49/51940
Apr. 8, 1975 Japan .....50/47453

[52] U.S. Cl. ..... 37/62; 37/63; 37/78

[51] Int. Cl.[2] ..... E02F 3/88

[58] Field of Search ..... 37/62, 63, 78, 61; 61/72.4

[56] References Cited

UNITED STATES PATENTS

| | | | |
|---|---|---|---|
| 3,217,499 | 11/1965 | Ishiki | 61/72.4 |
| 3,333,432 | 8/1967 | Hale et al. | 61/72.4 |
| 3,338,060 | 8/1967 | Harmstorf | 61/72.4 |
| 3,434,297 | 3/1969 | Gretter et al. | 61/72.4 |
| 3,462,963 | 8/1969 | Moore | 37/58 X |
| 3,638,439 | 2/1972 | Niederer | 61/72.4 |

FOREIGN PATENTS OR APPLICATIONS

| | | | |
|---|---|---|---|
| 556,671 | 10/1957 | Belgium | 37/63 |
| 1,111,692 | 7/1961 | Germany | 61/72.4 |
| 1,056,632 | 1/1967 | United Kingdom | 37/63 |

*Primary Examiner*—E. H. Eickholt
*Attorney, Agent, or Firm*—George B. Oujevolk

[57] ABSTRACT

In a water jet type underwater ground excavator wherein an underwater pump portion is carried on an excavator body including stabilizer sleds, an excavation portion protrudes downwardly and rearwardly under the excavator body, and water is delivered from the underwater pump portion to the excavation portion and then ejected from jet nozzles of the excavation portion so as to excavate the ground under water, an improvement by a sinker arm erected at a free end of the excavation portion in a manner to ascend and descend with upward and downward motions of the free end, whereby the stability of the excavator is enhanced. By joining to the sinker arm a brake equipment which suppresses the ascent thereof, the stability of the excavator is enhanced.

6 Claims, 11 Drawing Figures

WATER JET TYPE UNDERWATER GROUND EXCAVATOR

FIELD OF THE INVENTION

This invention relates to a water jet type underwater ground excavator which digs a trench in the ground at the bottom of a body of water in order to bury a cable, a water conveyance pipe or the like therein or to investigate the condition of the ground before the burying.

DESCRIPTION OF THE PRIOR ART

In laying a cable, a water conveyance pipe etc. at the bottom of a body of water, it is a recent practice to bury them in the ground under water for the purposes of protecting them, preventing any hindrance to the fishing industry and lowering the cost of laying. It is accordingly necessary to excavate a trench in the ground under water. An excavation for the geological survey of the ground under water is also carried out previous to the excavation for the burying.

Figure 1:
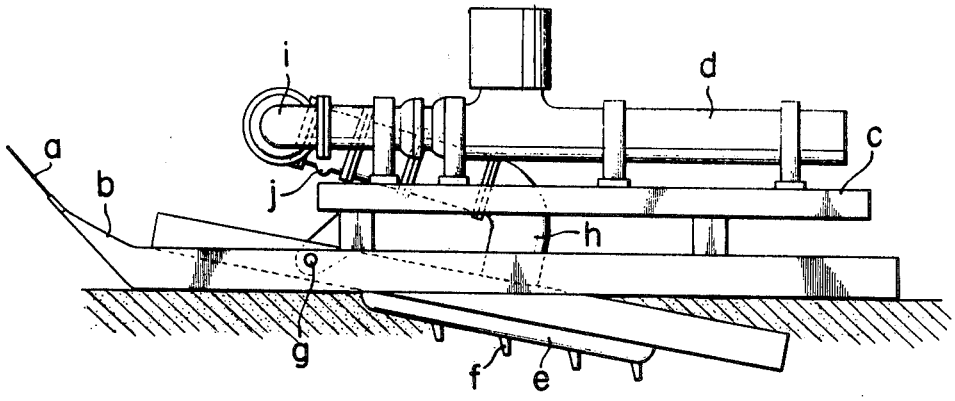
FIG. 1 PRIOR ART
FIG. 1 is a side view which shows essential portions of a prior-art, water jet type underwater ground excavator.
Figure 2:
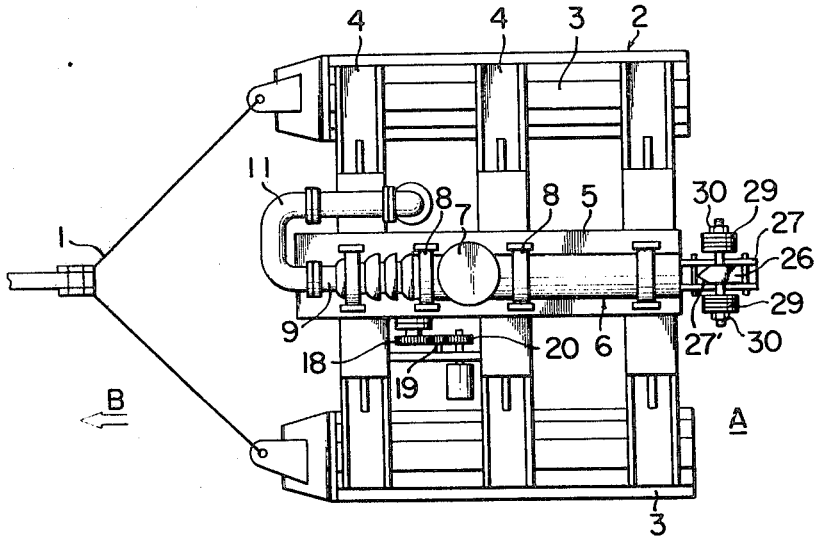
FIG. 2 is a plan view of an embodiment of a water jet type underwater ground excavator according to this invention.

There is known a water jet type underwater ground excavator which is towed by a mother ship or boat in case of investigating the ground under water with a variety of measuring instruments. The excavator is illustrated in FIG. 1. Referring to the figure, a tow rope *a* drags an excavator body *c*. The excavator body *c* has a stabilizing sled *b*, on which an underwater pump *d* is carried. Water fed by the pump *d* is ejected from jet nozzles *f* of a water jet type excavation portion *e* so as to excavate the ground under water. In this respect, the base end side of the excavation portion *e* is pivotally mounted on the excavator body *c* by a shaft *g*, while a penstock *h* protruding from the middle part of the excavation portion *e* and a water feed pipe *i* extending from the underwater pump *d* are coupled. Unavoidably an elastic coupling *j* being deformable is interposed between the water feed pipe *i* and the penstock *h*, so that the structure becomes complicated. Besides, an unreasonable force is exerted on the elastic coupling *j*. Moreover, the turning of the water jet type excavation portion *e* about the shaft *g* is not smooth. This causes an error when it is intended to measure the hardness of the ground under water on the basis of the inclination of the excavation portion *e*. Another problem is that, where the ground under water to be excavated is a hard geology such as rock, the attitude of the excavator is unstable due to the counteraction of the water jets, which sometimes results in even the lateral turning of the excavator.

SUMMARY OF THE INVENTION

An object of this invention is to provide a water jet type underwater ground excavator whose excavation arrangement can smoothly turn or incline.

Another object of this invention is to provide a water jet type underwater ground excavator whose attitude is kept stable during operation.

Still another object of this invention is to provide a water jet type underwater ground excavator which needs no elastic coupling.

Further objects of this invention will become apparent from the following description of preferred embodiments.

PREFERRED EMBODIMENTS OF THE INVENTION

Embodiment 1

This embodiment improves a sinker or weight mechanism for exerting a load on the water jet type excavation portion (*e* in FIG. 1), whereby the inclining motion of the excavation portion is made smooth, and besides, even when the inclination angle is changeful the load owing to a sinker or weight is prevented to the utmost from varying unwillingly.

In FIGS. 2 to 5, the embodiment is illustrated as an excavator for survey. An excavator body 2 to be towed through a tow rope 1 by a mother boat not shown, comprises stabilizing sleds 3 and 3 which are located on both the sides of the excavator body 2 and which glide on the bottom A of a body of water, transverse beds 4, 4 . . . which couple the stabilizing sleds 3 and 3, and a base 5 which is placed in the middle of the transverse beds 4, 4 . . . in parallel with the stabilizing sleds 3 and 3. An underwater pump portion 6 is carried on the excavator body 2.

Figure 4:
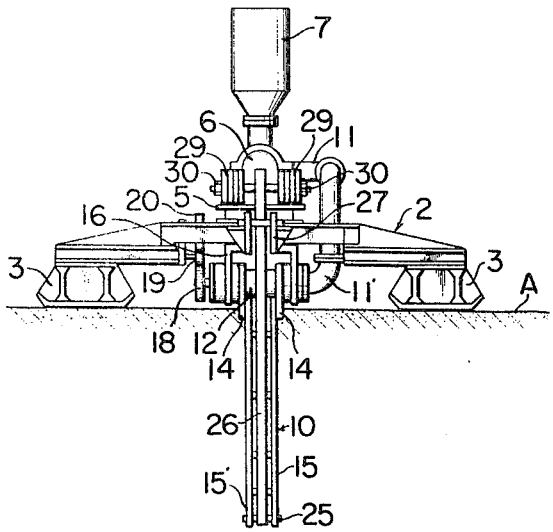
FIG. 4 is a rear view of the embodiment.
Figure 5:
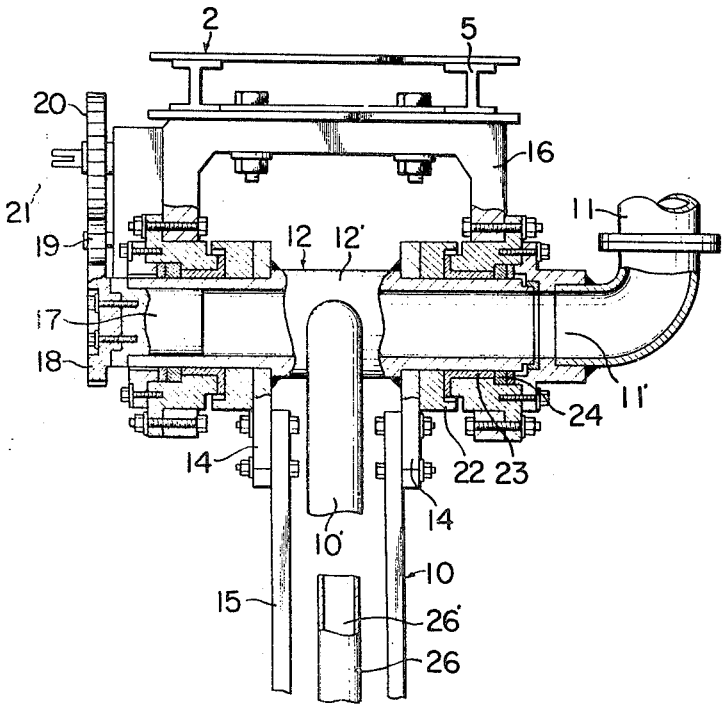
FIG. 5 is an enlarged vertical sectional rear view of a swivel joint portion of the embodiment.

Shown at 7 is a strainer which filters the sea water in the underwater pump portion 6. Numerals 8, 8 . . . indicate fittings for the pump portion 6. A discharge port portion 9 is coupled with a water feed pipe 11 by which the water from the underwater pump portion 6 is delivered to a water jet type excavation portion 10. The water feed pipe 11 is bent into the U-shape at the front end of the excavator body 2, and is extended rearwards. As is clearly shown in FIG. 5, it is further curved downwards and then bent towards a position underneath the base 5. Thus, an end port 11′ of the pipe 11 opens in a direction substantially orthogonal to a traveling direction B of the excavator body 2. As shown in FIGS. 4 and 5, the pipe end port 11′ has a swivel joint 12 coaxially coupled therewith. From a turnable lateral tube 12′ of the swivel joint 12, a main jet pipe 10′ of the water jet type excavation portion 10 communicating therewith protrude in a manner to rearwardly incline under the excavator body 2. As is known, a desired number of jet nozzles 13, 13 . . . are protruded from the main jet pipe 10′ so that the water from the underwater pump portion 6 may be ejected downwardly.

Guide bars 14 and 14 are protruded from the turnable lateral tube 12′. Fixed to the guide bars is a turnable arm 15, on which the main jet pipe 10′ is placed. As apparent from FIG. 3, the tips of the jet nozzles 13, 13 . . . are protected by the turnable arm 15.

As illustrated in detail in FIG. 5, the swivel joint 12 has the lateral tube 12′ turnably attached to a mounting frame 16 which is fixed under the base 5. One end of the turnable lateral tube 12′ is of course brought into communication with the end port 11′ of the water feed pipe 11, while the other end is closed by a blind plug 17. A reference point wheel 18 fixed to the blind plug 17 is turned along with the lateral tube 12′. The turning is transmitted to an intermediate wheel 19 and then to a displacement detection wheel 20, the wheels 19 and 20 being disposed on the mounting frame 16. The turning of the displacement detection wheel 20 is detected by a suitable detector 21. Thus, the inclination angle of the water jet type excavation portion 10 can be measured. In FIG. 5, reference numeral 22 designates a spacer, 23 a bearing metal, and 24 an oil seal.

At the free end 15′ of the turnable arm 15 of the water jet type excavation portion 10, there is pivotally mounted the lower end of a sinker or weight arm 26 which is set upright by a shaft 25 penetrating therethrough in the width direction of the excavator body 2. Thus, the arm 26 is made turnable along the traveling direction B of the excavator body 2. Further, a guide portion 27 is rearwardly protruded from the base 5 at the tail of the excavator body 2. The guide portion 27 is formed with a guide port 27′, through which the sinker arm 26 is passed in a manner to freely ascend and descend. The illustrated sinker arm 26 is curved into a circular arc so as to project rearwards. Stoppers 28 and 28′ are formed at upper and lower parts of the weight arm 26, respectively, and they prevent the arm 26 from coming out of the guide port 27′. A sinker or weight lead portion 26′ is contained in the sinker arm 26. At the upper end of the sinker arm 26, a weight shaft is penetratingly provided in parallel with the shaft 25. A desired number of weight plates 29, 29 . . . can be detachably mounted on the weight shaft. Numerals 30 and 30 denote lock nuts for the sinker plates 29, 29 . . . .

Figure 3:
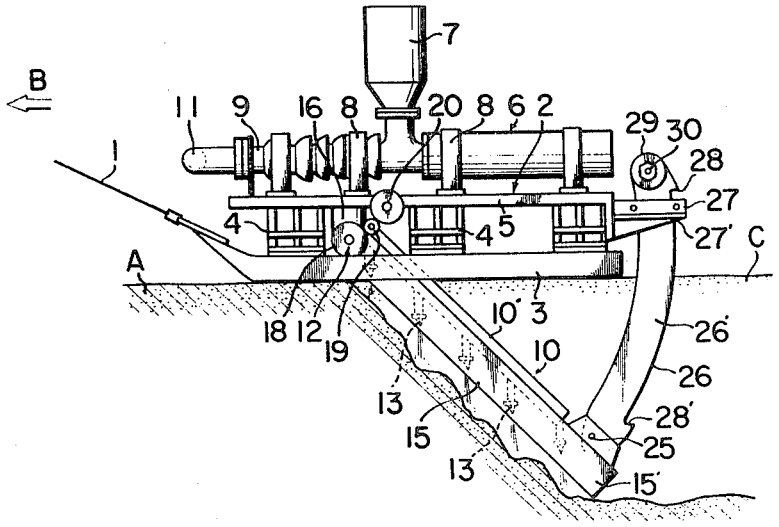
FIG. 3 is a side view of the embodiment in FIG. 2.

As described above, the embodiment of the water jet type underwater ground excavator comprises the excavator body 2 which includes the stabilizing sleds 3 adapted to glide on the bottom of the body of water, the underwater pump portion 6 which is carried on the excavator body 2, the water feed pipe 11 which is mounted on the excavator body 2, which delivers the water from the underwater pump portion 6 and whose end port 11′ is opened in the direction substantially orthogonal to the traveling direction of the excavator body 2, the swivel joint 12 which is coaxially coupled with the pipe end port 11′, the water jet type excavation portion 10 which is protruded from the swivel joint 12 in communication therewith and accordingly supported turnably by the water feed pipe and which is extended downwardly and rearwardly under the excavator body 2, the jet nozzles 13, 13 . . . which are provided in the water jet type excavation portion 10 and which eject the delivered water downwardly, the sinker arm 26 which is erected on the free end (15′) of the excavation portion 10, and the guide portion 27 which is mounted on the excavator body 2 and through which the sinker arm 26 is passed in a manner to freely ascend and descend. Since the elastic coupling *j* in the prior-art excavator shown in FIG. 1 is not required at all, the disadvantages relating to or ascribable to the elastic coupling can be eliminated. Since the weight arm 26 attached to the water jet type excavation portion 10 ascends or descends through the guide by the guide portion 27, a trench C is excavated as shown in FIG. 3 according to the hardness of the ground in such way that the water delivered from the underwater pump portion 6 is ejected against the underwater bottom A from the jet nozzles 13, 13 . . . of the water jet type excavation portion 10. In this case, if the bottom A of the body of water is hard, the excavation portion 10 will turn so as to rise along the sinker arm 26, whereas if the bottom A is soft, the excavation portion 10 will turn so as to fall. Herein, the load owing to the weight arm 26 as does not largely change in spite of the turning during the operation applies to a fixed position of the excavation portion 10. Therefore, when the excavator is used for the survey, a highly reliable result of measurement can be obtained merely by measuring the inclination angle of the water jet type excavation portion 10. When the excavator is used for the excavation for the cable burying, an efficient burying operation can be performed according to the quality of the bottom in such way that the mother boat is smoothly propelled by sacrificing the depth of the trench C to some extent at the hard bottom A.

Embodiment 2

In Embodiment 1, the amount of the ascent or descent of the excavation portion 10 is determined by the balance between the weight of the sinker arm 26 and the resistance against the excavation of the underwater ground. Accordingly, the ascending or descending motion is comparatively susceptible to geological changes and tug speed changes. In order to eliminate the drawback, the weight plates 29 and 29 may be made heavier. With such measure, however, when the excavation depth becomes small, the center of gravity shifts to a high position, and the burdens on the swivel joint 12 and on the free end 15′ are heavy. The stability and the mechanical strength are therefore spoilt.

Embodiment 2 illustrated in FIGS. 6 to 11 can solve the problem stated above.

Figure 6:
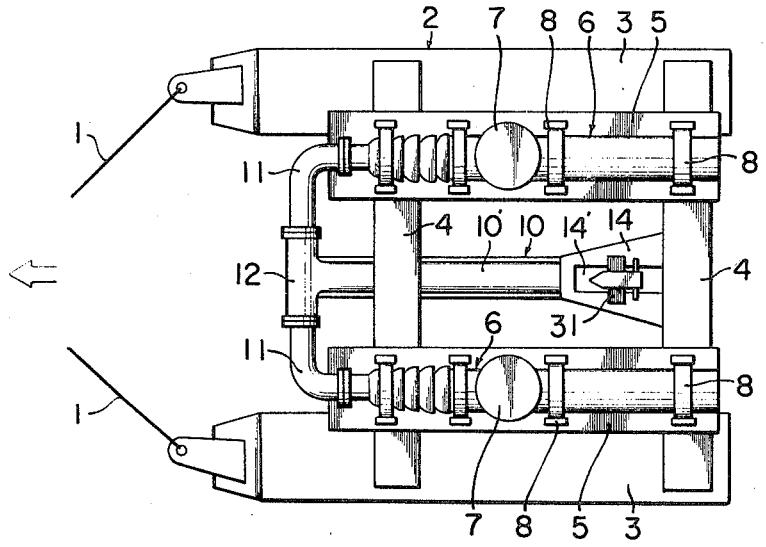
FIG. 6 is a plan view of another embodiment of the water jet type underwater ground excavator.
Figure 7:
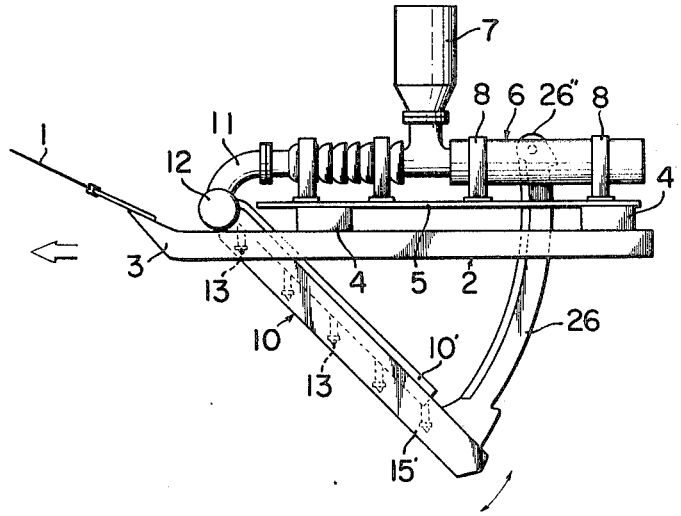
FIG. 7 is a side view of the embodiment in FIG. 6.

In FIGS. 6 and 7, the same symbols as in Embodiment 1 represent the same or corresponding members. As obvious from the figures, the excavator has two underwater pumps 6 and 6 which are carried on bases 5 and 5. A guide plate 14 frontwardly protruded from a transverse bed 4 at the tail of an excavator body 2 has a guide hole 14′, above which an upper end part 26″ of a sinker arm 26 projects. The other construction will be self-explanatory.

The sinker arm 26 has a brake equipment 31 joined thereto. The brake equipment 31 serves to control the load force on the excavation portion 10. It is required for the brake equipment 31 that a force to press down the free end side 15′ of the excavation portion 10 is great, that when the excavation resistance becomes high the sinker arm 26 can ascend smoothly, and that the depressing force acts on the excavation portion 10 even at the ascent. Insofar as the functions are satisfied, the brake equipment 31 may be in any form.

Figure 8:
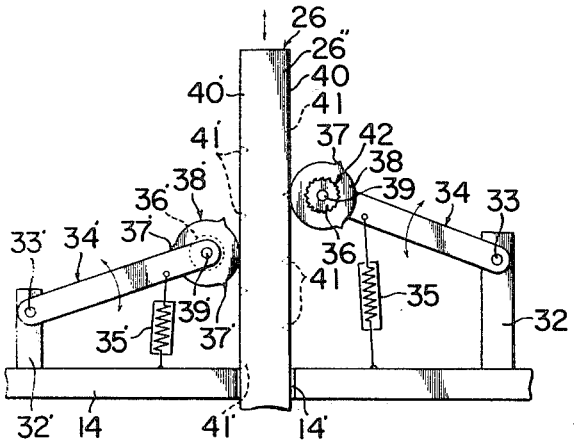
FIG. 8 is a side view which shows an example of a brake equipment constituting the embodiment in FIG. 6.
Figure 9:
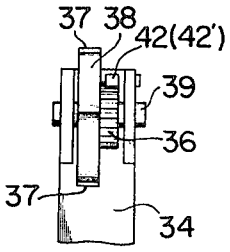
FIG. 9 is a fragmentary front view of the brake equipment in FIG. 8.

An example of the brake equipment 31 is shown in FIGS. 8 and 9. Posts 32 and 32′ are erected on the guide plate 14. On arbors 33 and 33′ attached to the respective posts 32 and 32′, elevating arms 34 and 34′ are pivotally mounted so as to be turnable in the directions of arrows. Springs 35 and 35′ which pull the arms 34 and 34′ downwards are disposed between fore end parts of the arms 34 and 34′ and the guide plate 14, respectively. At the fore ends of the arms 34 and 34′ as differ in height, rotary wheels 38 and 38′ and ratchet wheels 36 and 36′ integrally formed on side surfaces of the rotary wheels are respectively pivotally mounted on arbors 39 and 39′ so as to be turnable. The respective rotary wheels 38 and 38′ are formed at their outer peripheries with engaging protuberances 37 and 37′ which are equally spaced. The respective engaging protuberances 37 and 37′ are freely engaged with and disengaged from engaging cavities 41 and 41′ which are formed in both side surfaces 40 and 40′ in a manner to have spacings equal to those of the protuberances 37 and 37′ and to oppose to each other with a slight level difference. At the front ends of the elevating arms 34 and 34′, there are respectively provided pawls 42 and 42′ which are in engagement with the ratchet wheels 36 and 36′ so as to control the turnings of the wheels 36 and 36′ in the directions of arrows.

Where the ground at the bottom of a body of water is hard, the excavation resistance becomes high. When the free end side 15′ of the excavation portion 10 and accordingly the weight arm 26 intend to rise, the ratchet wheels 36 and 36′ are engaged with the corresponding pawls 42 and 42′ and are not rotated. Therefore, the rotary wheels 38 and 38′ are not rotated. Further, the ascent of the arm 26 is suppressed by the downward forces of the springs 35 and 35′. When the ascent force of the weight arm 26 becomes greater than the resultant suppressing force, the arm 26 rises for the first time while pulling the turning arms 34 and 34′ upwards. In this case, the engagement and disengagement between the protuberances 37 and the cavities 41 are performed alternately with those between the protuberances 37′ and the cavities 41′ with a fixed time difference.

Conversely, where the underwater ground is soft, the excavation resistance becomes low. The weight arm 26 falls owing to its own weight and the downward forces of the springs 35 and 35′ as transmitted through the rotary wheels 38 and 38′. Also in this case, the engagement and disengagement between the projections 37 and the notches 41 are performed alternately with those between the projections 37′ and the notches 41′ with the fixed time difference.

Figure 10:
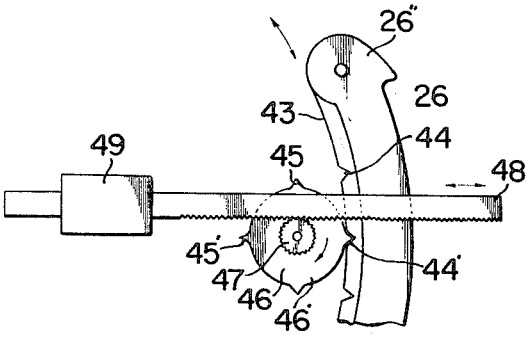
FIG. 10 is a side view which shows another example of the brake equipment.

Another example of the brake equipment 31 is shown in FIG. 10. On the inner side 43 of the sinker arm 26, notches 44, 44′ . . . are formed at equal spacings. Turnably disposed in front of the inner side 43 is a rotary wheel 46 in which protuberances 45, 45′ . . . engageable with the notches 44, 44′ . . . are protruded at spacings corresponding to those of the notches 44, 44′ . . . . A pinion 47 is integrally formed on a side surface 46′ of the wheel 46. The pinion 47 is engaged with a long rack 48 which is arranged substantially orthogonally to the sinker arm 26. A load device 49 is joined to the rack 48.

The load device 49 functions so that a descent force is bestowed on the weight arm 26 to normally exert a depressing force on the free end side 15′, that when the arm 26 intends to rise the rotation of the pinion 47 and the rotation of the rotary wheel 46 are stopped, and that when the ascent force of the arm 26 becomes greater than a predetermined value the ascent of the arm is allowed little by little.

Figure 11:
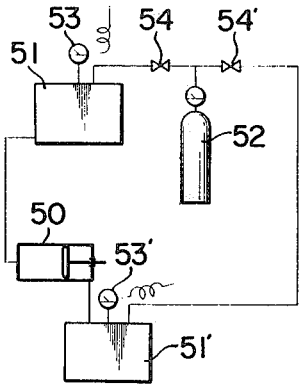
FIG. 11 is a schematic view which shows an example of a load mechanism constituting the brake equipment in FIG. 10.

The mechanism 49 may be a spring which urges the rack 48 rightwards. It may also be a type in which a member loaded with a fixed torque slips when the resistance exceeds the limit value, for example, the combination between a torque motor and a powder clutch. A further example of the mechanism 49 is shown in FIG. 11. An air cylinder 50 is used in combination with tanks 51 and 51′ and a bomb 52. While pressure gauges 53 and 53′ are being monitored, solenoid valves 54 and 54′ are actuated. Thus, the rise of the sinker arm 26 is controlled. With this example, a shock can be absorbed by utilizing the compressibility of air. It is also possible to lock the sinker arm 26 substantially perfectly when the ground under water is geologically uniform.

As described above, according to this embodiment, the brake equipment 31 for suppressing the ascent of the sinker arm 26 is joined to the arm 26 provided at the free end 15′ of the excavation portion 10. Therefore, even when the underwater ground to be excavated varies in hardness to some extent, the constant depressing force is imparted to the free end 15′ and hence the excavation depth is kept constant. Even when the free end 15′ is subjected to a somewhat high excavation resistance and the ascent force of the weight arm 26 becomes greater than the suppressing force of the brake equipment 31, the suppressing force is still applied to the arm 26 and hence the arm 26 is prevented from rising suddenly. In consequence not only the stability of the whole excavator is enhanced, but also the excavation is highly efficient and reliable.

We claim:

1. In a water jet type underwater ground excavator having an excavator body which includes stabilizing sleds, an underwater pump portion which is carried on said excavator body, and an excavation portion which protrudes downwardly and rearwardly under said excavator body and which includes jet nozzles, water being delivered from said underwater pump portion to said excavation portion and then ejected from said jet nozzles so as to excavate ground at a bottom of a body of water, a water jet type underwater ground excavator comprising a sinker arm which is erected at a free end of said excavation portion and which ascends and descends in pursuance of upward and downward motions of said free end, and a brake equipment which is joined to said sinker arm and which suppresses the ascent of said sinker arm.

2. A water jet type underwater ground excavator comprising: an excavator body which includes stabilizing sleds, at least one underwater pump which is carried on said excavator body, a water feed pipe mounted on said excavator body which delivers water from said underwater pump, a swivel joint which is coupled to said water feed pipe, a water jet type excavation portion which is turnably supported by said swivel joint which is extended downwardly and rearwardly under said excavator body, a sinker arm which is provided on a free end of said excavation portion and which can ascend and descend; an end port in said water feed pipe opened in a direction substantially orthogonal to a traveling direction of said excavator body, said swivel joint being coaxially coupled with said end port, and said water jet type excavation portion protruding from said swivel joint in communication therewith, and, a displacement detection wheel with a detector which is disposed on said excavator body, a turning of said water jet type excavation portion being transmitted to said displacement detection wheel and detected by said detector, whereby an inclination angle of said excavation portion is measured.

3. The water jet type underwater ground excavator according to claim 2, wherein said sinker arm has sinker plates detachably mounted thereon, so that its weight is variable.

4. The water jet type underwater ground excavator according to claim 2, further comprising a brake equipment which is joined to said sinker arm and which suppresses the ascent of said sinker arm adapted to ascend and descend in pursuance of upward and downward motions of said free end side.

5. The water jet type underwater ground excavator according to claim 4, wherein said brake equipment comprises turnable arms which are disposed on both sides of said sinker arm, notches which are formed in side surface of said sinker arm at predetermined spacings, turnable wheels which are each disposed at a fore end of the corresponding turnable arm and have protuberances, engageable with said notches in the corresponding side surface, provided at spacings equal to those of said notches, ratchet wheels which are each integrally formed on a side surface of the corresponding turnable wheel, pawls which are each provided at said fore end of said corresponding turnable arm and engaged with the corresponding ratchet wheel, and springs which each have one end retained at a fore part of said corresponding turnable arm and urge said corresponding turnable arm downwardly.

6. The water jet type underwater ground excavator according to claim 4, wherein said brake equipment comprises notches which are formed in a front surface of said sinker arm at predetermined spacings, a turnable wheel which is disposed on said front surface of said sinker arm and in which protuberances engageable with said notches are provided at spacings equal to those of said notches, a pinion which is integrally formed on a side surface of said turnable wheel, a rack which is arranged substantially orthogonally to said sinker arm and which is engaged with said pinion, and a load device which is joined to said rack and which exerts a load rearwardly.

* * * * *